US006632351B1

(12) United States Patent
Ngan et al.

(10) Patent No.: US 6,632,351 B1
(45) Date of Patent: Oct. 14, 2003

(54) THERMAL CRACKING OF CRUDE OIL AND CRUDE OIL FRACTIONS CONTAINING PITCH IN AN ETHYLENE FURNACE

(75) Inventors: Daniel Yuk-Kwan Ngan; Pui-Yuen Jeffrey Chan; Arthur James Baumgartner, all of Houston, TX (US)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 09/520,491

(22) Filed: Mar. 8, 2000

(51) Int. Cl.[7] ..... C10G 9/16

(52) U.S. Cl. ..... 208/132; 208/130; 208/128; 208/129; 585/648; 585/650

(58) Field of Search ..... 208/132, 128, 208/129, 130; 585/648, 650

(56) References Cited

U.S. PATENT DOCUMENTS 3,487,006 A 12/1969 Newman et al.
3,617,493 A 11/1971 Wirth et al. ..... 208/80
4,426,278 A * 1/1984 Kosters ..... 208/130
4,498,629 A * 2/1985 Grondman ..... 239/434.5
4,673,486 A * 6/1987 Orihashi et al. ..... 208/86
5,190,634 A * 3/1993 Fernandez-Baujin et al. .... 208/107
5,580,443 A * 12/1996 Yoshita et al. ..... 208/130
5,733,438 A * 3/1998 Tong et al. ..... 208/48 R
5,817,226 A * 10/1998 Lenglet ..... 208/130

OTHER PUBLICATIONS

"Improved Field Condensate Cracking Trends in Industrial Application," by Mal J. Maddock, Ph.D., Paper presented at Refining, LNG and Petrochem Asia 92, Dec. 1–4, 1992, Singapore.

* cited by examiner

*Primary Examiner*—Nadine Norton

(57) ABSTRACT

A crude oil feedstock or crude oil fractions containing pitch feedstock is pyrolyzed in a pyrolysis furnace.

68 Claims, 6 Drawing Sheets

THERMAL CRACKING OF CRUDE OIL AND CRUDE OIL FRACTIONS CONTAINING PITCH IN AN ETHYLENE FURNACE

1. FIELD OF THE INVENTION

The invention pertains to a method for the manufacture of ethylene in a pyrolysis furnace, and more particularly to a method for modifying an ethylene furnace to accept and process a feedstock of crude oil and crude oil fractions containing pitch.

2. BACKGROUND OF THE INVENTION

The production of olefins, in particular ethylene, is achieved conventionally by the thermal cracking of petroleum hydrocarbon feedstocks using natural ga liquids, (NGL's) such as ethane or by using the naphtha or gas oil fractions produced from a crude distillation column operating above atmospheric pressure. More recently, the trend in some regions is toward designing crackers to accommodate the use of heavier feedstocks, such as vacuum gas oils. These heavier feedstocks, however, foul tubes in convection section preheaters and downstream equipment by coke deposition. Typical process temperatures at the exit of the convection section first stage preheaters range from about 200–400° C., thereby completely vaporizing the feedstock within the convection section, or in heavy feed cases such as gas oil and vacuum gas oil, finally and completely vaporizing the feedstock externally as it proceeds toward the second stage preheaters through a mix nozzle with superheated steam as described in U.S. Pat. No. 4,498,629 to Grondman, entitled "Apparatus for Vaporization of a Heavy Hydrocarbon Feedstock With Steam."

U.S. Pat. No. 5,580,443 discloses a process for cracking low quality feedstock such as a heavy natural gas-liquid, which is an associated oil occurring in small quantities with the production of gas from gas fields. The process is described as processing the feedstock through a first stage preheater within the convection zone to a vapor/liquid separator external to the convection zone after being mixed with superheated steam, a second stage preheater within a convection zone, and finally to the radiant zone. The feedstock is cracked by separating and removing in a vapor-liquid separator a portion of heavy fractions from the first stage preheater section, and subsequently returning the vaporized portion of the feedstock to the second stage preheater before subjecting the feedstock to pyrolysis. The temperature and pressure within the first stage preheater tubes are maintained within a range such that those fractions of the feed which would otherwise cause coking problems in the tubes are kept in liquid state, while fractions unlikely to cause coking problems are fully evaporated. Typical exit temperatures from the first preheater section range from 150° C.–350° C. in order to avoid vaporizing the coke generating fractions within the tubes.

The gas-liquid mixture exiting the first preheater section is described in U.S. Pat. No. 5,580,443 as within a ratio of 60/40 to 98/2. This ratio can be adjusted by the addition of superheated dilution steam at a point between the exit port of the first preheater section and prior to entry in a vapor-liquid separator. Once in the vapor-liquid separator, the heavy unevaporated liquid fractions are removed and discharged from the system, while the gaseous fraction is passed through a gas delivery line, mixed with superheated dilution steam again, and then passed to the second preheater. In the second preheater, the gas is heated up to a temperature just below the temperature at which cracking is promoted, after which it passes into the radiant section and is cracked.

It would be desirable to process feeds other than heavy natural gas-liquids through a pyrolysis furnace for the manufacture of ethylene. Desirable feeds include crude oil or the long residue from the bottoms of a crude oil atmospheric column. Crude oil feed is derived from oil fields wherein 60% or more of the production extract in liquid form is a crude oil. A heavy natural gas-liquid stream is in a gaseous or supercritical state in the ground, which condenses into a liquid as it reaches surface temperatures and pressures. Processing a crude oil feedstock or the long residue of a crude oil atmospheric column through a pyrolysis furnace under the temperature conditions described in U.S. Pat. No. 5,580,443, and in particular at a temperature ranging from 150°–350° C. in a first preheating stage, or at any temperature at which those fractions likely to cause coking problems remain in liquid state and those fractions unlikely to coke the tubes are fully evaporated, would be disadvantageous because at the lower temperatures at which heavy natural gas-liquids are processed, 150° C.–350° C., insufficient fractions of vaporized crude oil or long residues are recovered, resulting in reduced yields of desirable olefin production from these feedstocks.

The heavy ends of crude oil and long residue cannot be vaporized under typical olefins pyrolysis furnace convection section conditions. The heavy ends of crude oil and long residue are normally removed by distillation, and the lighter vaporizable fractions from a distillation, most commonly the naphtha or gas oil fractions, are used as the feed for olefins pyrolysis plants. This distillation preparation step for crude oils and long residue requires additional capital and adds additional operating cost to the process.

3. SUMMARY OF THE INVENTION

There is now provided a process for pyrolyzing a crude oil feedstock or crude oil fractions containing pitch feedstock, and a pyrolysis furnace, comprising feeding the crude oil or crude oil fractions containing pitch feedstock to a first stage preheater within a convection zone, wherein said crude oil or crude oil fractions containing pitch feedstock is heated within the first stage preheater to an exit temperature of at least 375° C. to produce a heated gas-liquid mixture, withdrawing from first stage preheater the gas-liquid mixture to a vapor-liquid separator, separating and removing the gas from the liquid in the vapor-liquid separator, and feeding the removed gas to a second preheater provided in the convection zone, further heating the temperature of said gas to a temperature above the temperature of the gas exiting the vapor-liquid separator, introducing the preheated gas into a radiant zone within the pyrolysis furnace, and pyrolyzing the gas to olefins and associated by-products.

There is also provided a process for pyrolyzing a crude oil or crude oil fraction containing pitch feedstock comprising feeding said feedstock to a first stage preheater within a convection zone of an olefins pyrolysis furnace, heating said feedstock to a temperature at which non-coking fractions and a portion of coking fractions are fully evaporated to a gas, and the remaining portion of coking fractions are maintained in a liquid phase, while maintaining a gas/liquid weight ratio of said crude oil in the first stage preheater within a range of 60/40–98/2, withdrawing the gas/liquid mixture from the first stage preheater and feeding the gas/liquid mixture to a vapor/liquid separator, separating the gas from said gas/liquid mixture in the vapor-liquid separator and removing said gas from the vapor-liquid separator, feeding said removed gas to a second stage preheater in the convection zone, heating said gas in the second stage preheater, and feeding a second stage preheated gas to a radiant heat transfer zone in the pyrolysis furnace.

There is also provided a process for pyrolyzing a crude oil or crude oil fractions containing pitch feedstock comprising feeding a crude oil or crude oil fractions containing pitch feedstock to a first stage preheater in a convection zone of an olefins pyrolysis furnace, heating the crude oil or crude oil fractions containing pitch feedstock in the first stage preheater to a temperature of at least 400° C. while simultaneously feeding a dilution gas in the first stage preheater, wherein the gas-liquid weight ratio ranges from 60/40–98/2.

Each of the above processes are also used to process a long residue and any crude oil fractions containing pitch.

The process of the invention allows one to feed a crude oil or crude oil fractions containing pitch feedstock into the convection zone of a pyrolysis furnace without having to decoke the tubes in the convection zone any sooner than the radiant tubes of a furnace. The process of the invention extends the capability of an ethylene furnace to flash a feedstock (a feed of crude oil or crude oil fraction containing pitch) at a higher temperature (e.g. 480° C.) that is not generally achievable at the bottoms of a vacuum distillation column under normal operating conditions (about 415° C.), thereby allowing one to recover a higher fraction of the crude oil or crude oil fractions containing pitch as vapor useful for cracking in the radiant heat transfer zone in a pyrolysis furnace than that recovered through atmospheric or vacuum distillation columns. The process of the invention also has the advantage of processing a crude oil or crude oil fractions containing pitch feed without having to first subject the crude oil or crude oil fractions containing pitch feed to fractionation, thereby allowing one to process a cheaper source of feedstock in a pyrolysis furnace. Finally, the large quantity of higher boiling fractions in crude oil or crude oil fractions containing pitch, unlike heavy natural gas liquids, wet the inner surfaces of the tubes in the convection zone at suitable linear velocities under the operating temperatures described herein, thereby making crude oil or crude oil fractions containing pitch a suitable feed and minimizing the formation of coke within the convection zone tubes.

4. BRIEF DESCRIPTION OF THE DRAWINGS

5. DETAILED DESCRIPTION OF THE INVENTION

Figure 1:
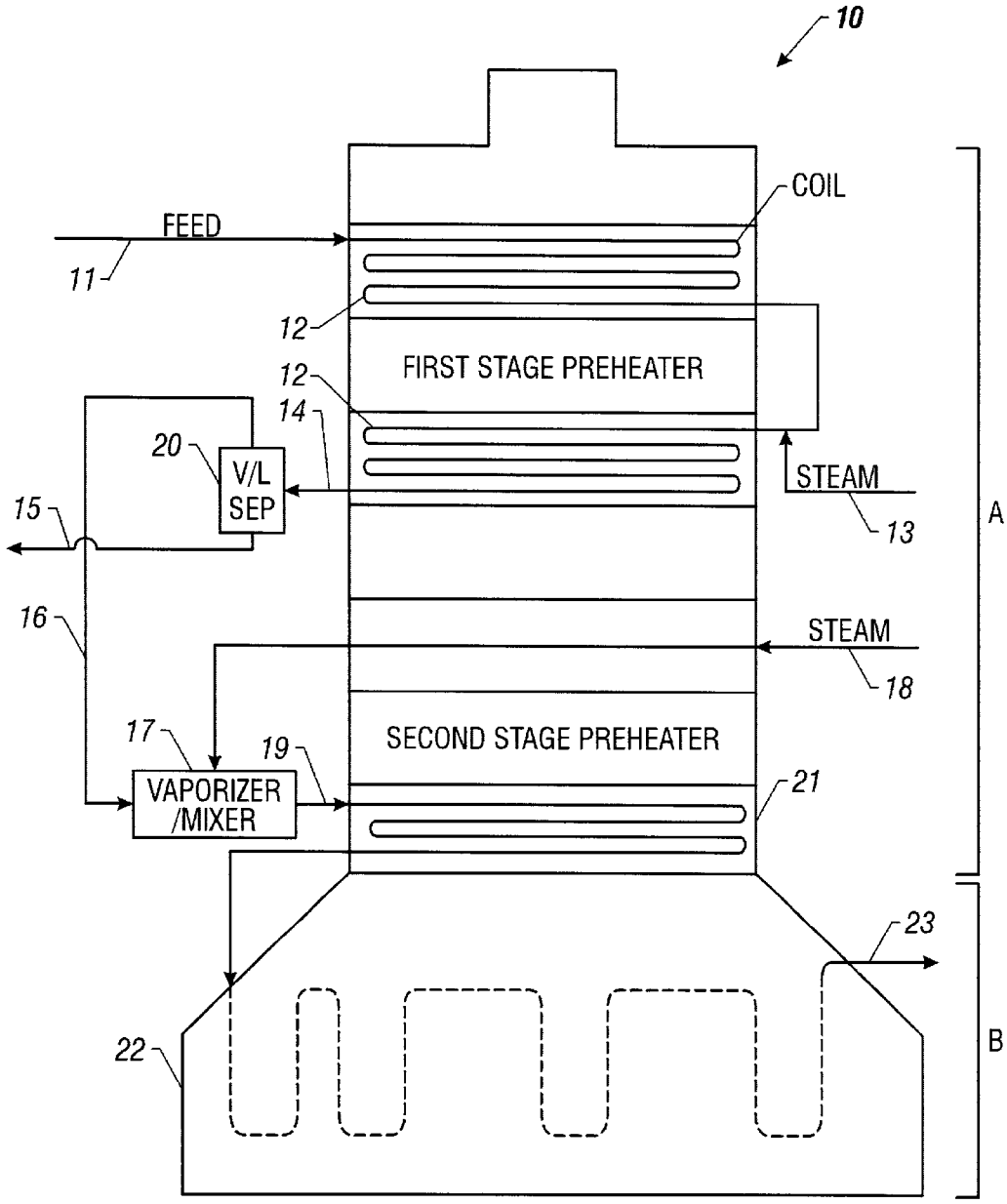
FIG. 1 is a schematic process flow diagram of a pyrolysis furnace.

The invention is described below while referring to FIG. 1 as an illustration of the invention. It is to be understood that the scope of the invention may include any number and types of process steps between each described process step or between a described source and destination within a process step. For example, any number of additional equipment or process steps may lie between the vapor/liquid separator and the second stage preheater, and any number of additional equipment or process steps may lie between "feeding said removed gas (from the vapor/liquid separator as the source) to a second stage preheater (the destination)."

The olefins pyrolysis furnace 10 is fed with a crude oil or crude oil fractions containing pitch feed or a long residue feed 11 entering into the first stage preheater 12 of a convection zone A. Crude oil feedstocks are referred to throughout the specification as a feedstock of the invention, but it is to be understood that long residue feedstocks are also suitable feedstocks which may be used in lieu of or in combination with crude oil feedstocks whenever crude oil feedstocks are referred to. Further, for convenience, it is to be understood that every mention of crude oil throughout the specification includes crude oil and crude oil fractions containing pitch. Accordingly, the scope of the invention includes long residue and crude oil fractions containing pitch whenever crude oil is mentioned as a feedstock.

Suitable crude oil feedstocks used in the invention have the following characteristics. Each characterization of the crude oil feedstock is measured according to ASTM D-2887:

85 wt. % or less of the crude oil feedstock will vaporize at 350° C., and 90 wt. % or less of the crude oil feedstock will vaporize at 400° C.

Feedstocks within the above range of characteristics minimize coking within the tubes of the convection section of a pyrolysis furnace under the operating conditions described herein. The weight percentage of lighter feedstocks, such as most heavy natural gas liquids, vaporized at 300° C., 350° C., or 400° C. is so high that the vaporization of the coking fraction would quickly coke the tubes within the first stage preheater at the temperatures used in this invention.

In a preferred embodiment, the crude oil specified for the feedstock has the following characteristics:

65 wt. % or less vaporizing at 300° C., and 80 wt. % or less of the crude oil feedstock vaporizing at 350° C., and 88 wt. % or less of the crude oil feedstock will boil at 400° C.

In a more preferred embodiment, 60 wt. % or less or the crude oil and long residue vaporizes at 300° C., and 70 wt. % or less of the crude oil feedstock vaporizes at 350° C., and 80 wt. % or less of the crude oil feedstock will vaporize at 400° C.

In a most preferred embodiment, the crude oil feedstock will have the following characteristics:

55 wt. % or less or the crude oil vaporizes at 300° C., and 65 wt. % or less of the crude oil feedstock vaporizes at 350° C., and 75 wt. % or less of the crude oil feedstock will vaporize at 400° C.

Typical crude oil feedstocks will have API gravities not higher than 45.

Long residue feedstocks are the bottoms of an atmospheric distillation column used to process and fractionate desalted crude oil, also commonly known as atmospheric tower bottoms. This atmospheric distillation column separates diesel, kerosene, naphtha, gasoline, and lighter components from the crude. Long residues satisfy the above specification for suitable feeds used in the invention, and will also satisfy the following specification:

35 wt. % or less, more preferably 15 wt. % or less, and even 10 wt. % or less, vaporizing at 350° C., and 55 wt. % or less, more preferably 40 wt. %, and even 30 wt. % or less, vaporizing at 400° C.

The pressure and temperature at which the crude oil and/or long residue feedstock is fed to the inlet of the first stage preheater in the convection zone is not critical so long as the feedstock is flowable. The pressure generally ranges from between 100–400 psig, more preferably from 150 to 250 psig, and the temperature of the crude oil is generally set from ambient to below the flue gas temperature in the convection zone where it will first be heated, typically from 140° C.–300° C. Feed rates are not critical, although it would be desirable to conduct a process at a feedrate ranging from 50,000–100,000 lbs. of crude oil and/or long residue feed per hour.

The first stage preheater 12 in the convection section is typically a bank of tubes, wherein the contents in the tubes are heated primarily by convective heat transfer from the combustion gas exiting from the radiant section of the pyrolysis furnace. In one embodiment, as the crude oil and/or long residue feedstock travels through the first stage preheater 12, it is heated to a temperature which promotes evaporation of non-coking fractions into a vapor state and evaporation of a portion of coking fractions into a vapor state, while maintaining the remainder of the coking fractions in a liquid state. We have found that with a crude oil and/or long residue feedstock, it is desirable to fully evaporate the crude oil and/or long residue fractions which do not promote coking in the first stage preheaters, and in addition, maintain a temperature sufficiently elevated to further evaporate a portion of the crude oil and/or long residue feedstock comprised of fractions which promote coking of the tubes in the first stage preheater and/or the second stage preheater. The coking phenomenon in the first stage preheater tubes is substantially diminished by maintaining a wet surface on the walls of the heating tubes. So long as the heating surfaces are wetted at a sufficient liquid linear velocity, the coking of those surfaces is inhibited.

The optimal temperature at which the crude oil and/or long residue feedstock is heated in the first stage preheater of the convection zone will depend upon the particular crude oil and/or long residue feedstock composition, the pressure of the feedstock in the first stage preheater, and the performance and operation of the vapor/liquid separator. In one embodiment of the invention, the crude oil and/or long residue feedstock is heated in the first stage preheater to an exit temperature of at least 375° C., and more preferably to an exit temperature of at least 400° C. In one embodiment, the exit temperature of the feedstock from the first stage preheater is at least 415° C.

The upper range on the temperature of the crude oil and/or long residue feedstock in the first stage preheater tubes 12 is limited to the point at which the stability of the crude oil and/or long residue feedstock is impaired. At a certain temperature, the coking propensity of the feedstock increases because the asphaltenes in the pitch begin to drop out of solution or phase separate from the solublizing resins in the feedstock. This temperature limit would apply to both the first stage preheater tubes and all tubes connecting up to and including the vapor/liquid separator. Preferably, the exit temperature of the crude oil and/or long residue feedstock within the first stage preheater is not more than about 520° C., and most preferably not more than 500° C.

Each of the temperatures identified above in the first stage preheater are measured as the temperature the gas-liquid mixture attains at any point within the first stage preheater, including the exit port of the first stage preheater. Recognizing that the temperature of the crude oil and/or long residue feedstock inside the tubes of the first stage preheater changes over a continuum, generally rising, as the crude oil and/or long residue flows through the tubes up to the temperature at which it exits the first stage preheater, it is desirable to measure the temperature at the exit port of the first stage preheater from the convection zone. At these exit temperatures, both a coke promoting fraction and a non-coking fraction of the crude oil and/or long residue feedstock will be evaporated into a gas phase, while maintaining the remainder of the coke promoting fraction in a liquid phase in order to adequately wet the walls of all heating surfaces. The gas-liquid ratio should range from 60/40–98/2 by weight, more preferably 90/10–95/5, by weight, in order to maintain a sufficiently wetted tube wall, minimize coking, and promote increased yields.

The temperature conditions within the first stage preheater are suitably adapted to the use of a crude oil and/or long residue feedstock, and are not recommended for a heavy natural gas-liquid feed. Feeding a heavy natural gas-liquid having coking fractions through the first stage preheater at the process conditions of the invention would evaporate the feedstock to its dry point, and within days to a week coke up the furnace tubing in the convection section to the point where a shutdown is required.

The pressure within the first stage preheater 12 is not particularly limited. The pressure within the first stage preheater is generally within a range of 50 psig–300 psig, more preferably from about 60–180 psig.

In an optional but preferred embodiment of the invention, a feed of dilution gas 13 may be added to the crude oil and/or long residue feedstock in the first stage preheater at any point prior to the exit of the gas-liquid mixture from the first stage preheater. In a more preferred embodiment, dilution gas 13 is added to the crude oil and/or long residue feedstock of the first stage preheater at a point external to pyrolysis furnace for ease of maintaining and replacing equipment.

The feed of dilution gas is a stream which is a vapor at the injection point into the first stage preheater. Any gas can be used which promotes the evaporation of non-coking fractions and a portion of coking fractions in the crude oil and/or long residue feedstock. The dilution gas feed also assists in maintaining the flow regime of the feedstock through the tubes whereby the tubes remain wetted and avoid a stratified flow. Examples of dilution gases are dilution steam (saturated steam at its dewpoint), methane, ethane, nitrogen, hydrogen, natural gas, dry gas, refinery off gases, and a vaporized naphtha. Preferably, the dilution gas is dilution steam, a refinery off gas, vaporized naphtha, or mixtures thereof.

The temperature of the dilution gas is at a minimum sufficient to maintain the stream in a gaseous state. With respect to dilution steam, it is preferably added at a temperature below the temperature of the crude oil feedstock measured at the injection point to ensure that the dilution gas does not condense, more preferably 25° C. below the crude oil feedstock temperature at the injection point. Typical dilution steam temperatures at the dilution gas/feedstock junction range from 140° C. to 260° C., more preferably from 150° C. to 200° C.

The pressure of dilution gas is not particularly limited, but is preferably sufficient to allow injection. Typical dilution gas pressures added to the crude oil is generally within the range of 70–200 psig.

It is desirable to add dilution gas into the first stage preheater in an amount up to 0.5:1 lbs. of gas per lb. of crude oil, preferably up to 0.3:1 lbs. of gas per lb. of crude oil and/or long residue feedstock.

Alternatively, a feed of dilution fluid 13 (the fluid being in a liquid or mixed liquid/gas phase) may be added to the crude oil feedstock in the first stage preheater at any point prior to the exit of the gas-liquid mixture from the first stage preheater. Examples of dilution fluids are liquids that are easily vaporized along with crude such a liquid water, or naphtha in combination with other dilution liquids or gases. In general, a dilution fluid is preferred when the injection point is at a location where crude is still in the liquid phase, and dilution gases are preferred when the injection point is at a location where crude is either partially or wholly vaporized.

In a further alternative embodiment, superheated steam can be added to the first stage preheater in line 13 to promote further evaporation of the crude oil feedstock within the first stage preheater tubes.

Once the crude oil feedstock has been heated to produce a gas-liquid mixture, it is withdrawn from the first stage preheater through line 14, directly or indirectly to a vapor/liquid separator as a heated gas-liquid mixture. The vapor/liquid separator removes the non-vaporized portion of the crude oil and/or long residue feed, which is withdrawn and separated from the fully vaporized gases of the crude oil and/or long residue feed. The vapor/liquid separator can be any separator, including a cyclone separator, a centrifuge, or a fractionation device commonly used in heavy oil processing. The vapor/liquid separator can be configured to accept side entry feed wherein the vapor exits the top of the separator and the liquids exit the bottom of the separator, or a top entry feed wherein the product gases exit the side of the separator.

The vapor/liquid separator operating temperature is sufficient to maintain the temperature of the gas-liquid mixture within the range of 375° C. to 520° C., preferably within the range of 400° C. to 500° C. The vapor/liquid temperature can be adjusted by an means, including increasing a flow of superheated dilution steam to the gas-liquid mixture destined for the vapor/liquid separator as described in further detail below with respect to FIG. 5, and/or by increasing the temperature of the feedstock to the furnace from external heat exchangers.

Figure 2:
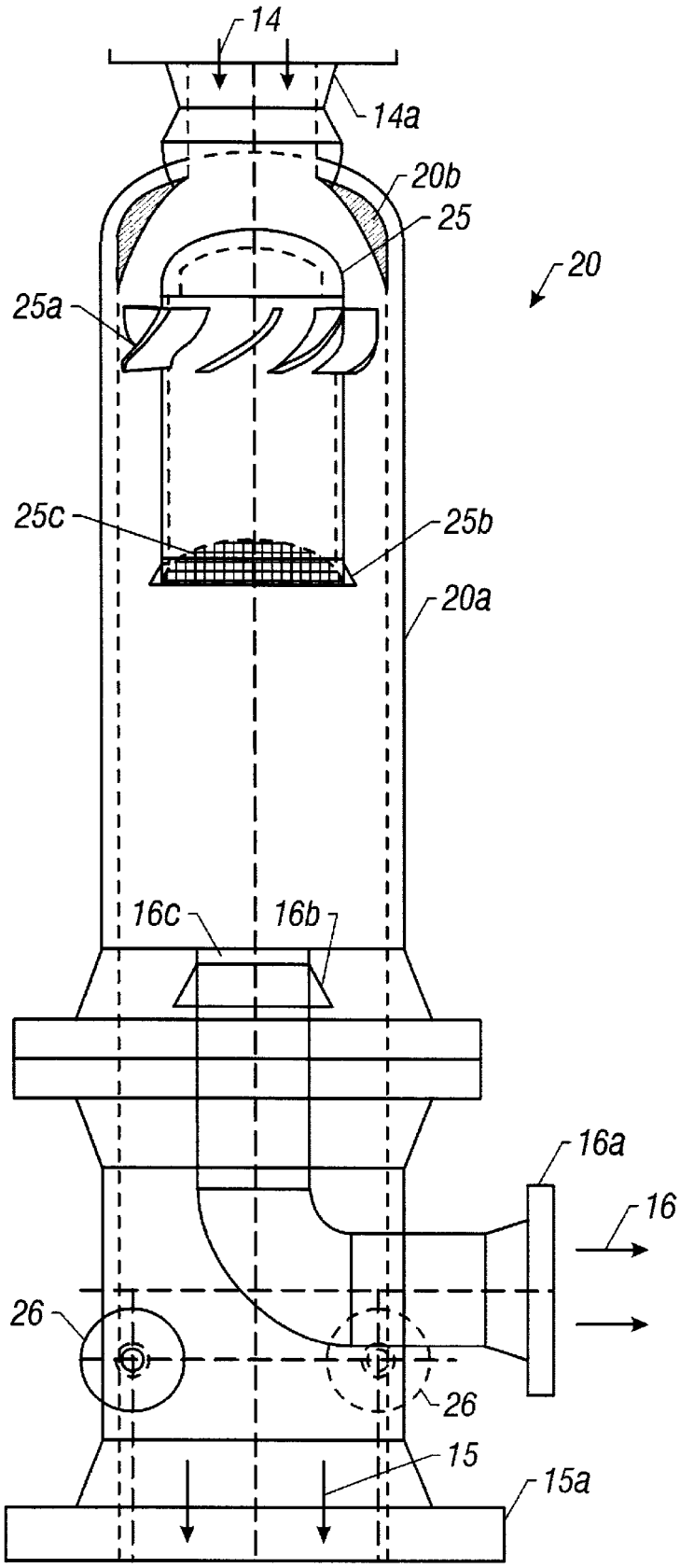
FIG. 2 is an elevation view of a vapor/liquid separator.
Figure 3:
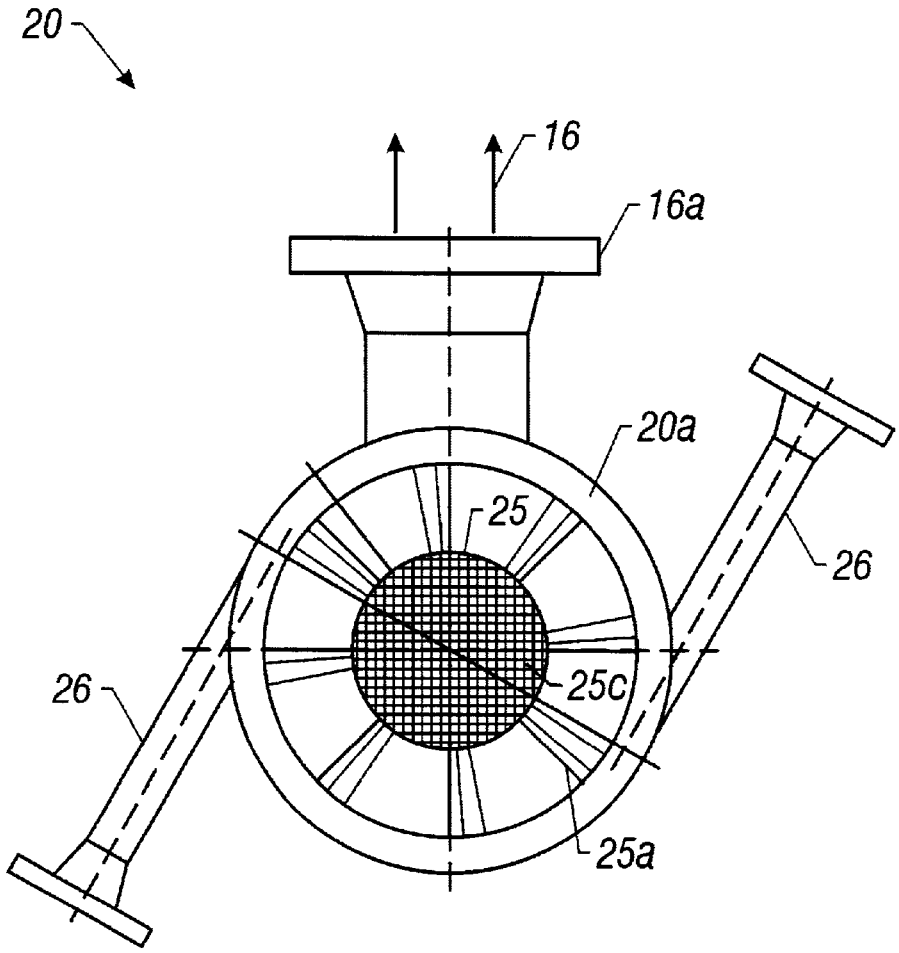
FIG. 3 is a plan view of FIG. 2.

In a preferred embodiment, the vapor/liquid separator is described in copending application TH1497 entitled, "A Wetted Wall Vapor/Liquid Separator." Referring now to FIGS. 2 and 3, the vapor/liquid separator 20 is shown in a vertical, partly sectional view in FIG. 2 and in a sectional plan view in FIG. 3. The conditions of the gas-liquid mixture in line 14 at the entrance of the vapor/liquid separator 20 are dependent on the feedstock 11 properties. There should be sufficient non-vaporized liquid 15 (between 2–40 vol % of the feedstock, preferably 2–5 vol % of the feedstock) to wet the internal surfaces of the vapor/liquid separator 20. This wetted wall requirement is essential to decrease the rate of, if not prevent, coke formation and deposition on the surface of the separator 20. The degree of vaporization (or vol % of non-vaporizable liquid 15) can be controlled by adjusting the dilution steam/feedstock ratio and flash temperature of the gas-liquid mixture 14.

The vapor/liquid separator 20 described herein permits separation of the liquid 15 and vapor 16 phases of the flash mixture in such a manner that coke solids are not allowed to form and subsequently foul either the separator 20 or the downstream equipment (not shown). On account of its relatively compact construction, the wetted-wall vapor/liquid separator 20 design can achieve a higher temperature flash than that in a typical vacuum crude column, thus effecting the recovery of a higher vaporized fraction 16 of the feed 11 for further downstream processing. This increases the fraction of feedstock 11 which can be used for producing higher valued products 23, and reduces the fraction of heavy hydrocarbon liquid fraction 15 having a lower value.

Figure 4:
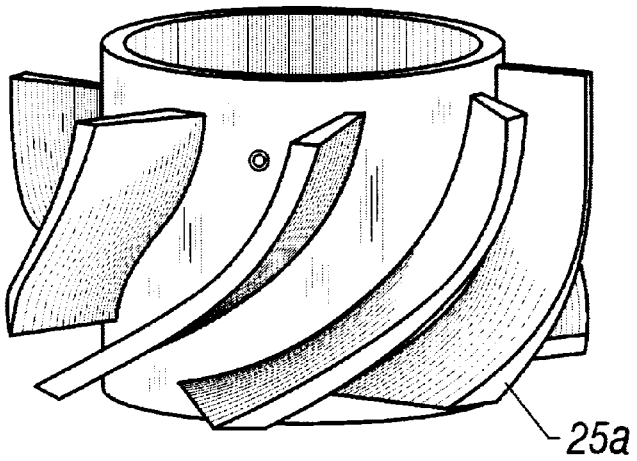
FIG. 4 is a perspective drawing of the vane assembly of the vapor/liquid separator of FIG. 2.

Referring to FIG. 2, the vapor/liquid separator 20 comprises a vessel having walls 20*a*, an inlet 14*a* for receiving the incoming gas-liquid mixture 14, a vapor outlet 16*a* for directing the vapor phase 16 and a liquid outlet 15*a* for directing the liquid phase 15. Closely spaced from the inlet 14*a* is a hub 25 having a plurality of vanes 25*a* spaced around the circumference of the hub 25, preferably close to the end nearest the inlet 14*a*. The vane assembly is shown more clearly in the perspective view of FIG. 4. The incoming gas-liquid mixture 14 is dispersed by splashing on the proximal end of the hub 25 and, in particular, by the vanes 25*a* forcing a portion of the liquid phase 15 of the mixture 14 outwardly toward the walls 20*a* of the vapor/liquid separator 20 thereby keeping the walls 20*a* completely wetted with liquid and decreasing the rate of, if not preventing, any coking of the interior of the walls 20*a*. Likewise, the outer surface of the hub 25 is maintained in a completely wetted condition by a liquid layer that flows down the outer surface of hub 25 due to insufficient forces to transport the liquid 15 in contact with the surface of hub 25 to the interior of the walls 20*a*. A skirt 25*b* surrounds the distal end of the hub 25 and aids in forcing any liquid transported down the outer surface of the hub 25 to the interior of the walls 20*a* by depositing said liquid into the swirling vapor. The upper portion of the vapor/liquid separator 20 is filled in at 20*b* between the inlet 14*a* and hub 25 to aid wetting of the interior of walls 20*a* as the ga-liquid mixture 14 enters the vapor/liquid separator 20. As the liquid 15 is transported downward, it keeps the walls 20*a* and the hub 25 washed and reduces, if not prevents, the formation of coke on their surfaces. The liquid 15 continues to fall and exits the vapor/liquid separator 20 through the liquid outlet 15*a*. A pair of inlet nozzles 26 is provided below the vapor outlet tube 16*a* to provide quench oil for cooling collected liquid 15 and reduce downstream coke formation. The vapor phase 16 enters the vapor outlet duct 16*a* at its highest point 16*c*, exits at outlet 16*a* and proceeds to a vaporizer 17 for further treatment prior to entering the radiant section of the pyrolysis furnace as shown in FIG. 1. A skirt 16*b* surrounds the entrance 16*c* to the vapor duct 16 and aids in deflecting any liquid 15 outwardly toward the separator walls 20*a*.

The distance of the hub 25 extension below the vanes 25*a* was picked based on estimation of the liquid drop size that would be captured before the drop had moved more than half way past the hub 25. Significant liquid 15 will be streaming down the hub 25 (based on observations with the air/water model) and the presence of a 'skirt' 25*b* on the hub 25 will introduce liquid droplets into the vapor phase well below the vanes 25*a*, and collection will continue below the skirt 25*b* of hub 25 due to the continued swirl of the vapor 16 as it moves to the outlet tube 16*a*.

The hub skirt 25*b* was sized to move liquid from the hub 25 as close as possible to the outer wall 20*a* without reducing the area for vapor 16 flow below that available in the vanes 25*a*. As a practical matter, about 20% more area for flow has been provided than is present at the vanes 25*a*.

The distance between the bottom of the hub 25 and the highest point 16*c* of vapor outlet tube 16*a* was sized as four times the vapor outlet tube 16*a* diameter. This was consistent with the air/water model. The intent is to provide area for the vapor to migrate to the outlet 16*a* without having extremely high radial velocities.

The distance from the entrance 16*c* of the vapor outlet tube 16*a* to the centerline of the horizontal portion of vapor outlet pipe 16*a*, has been chosen as roughly three times the pipe diameter. The intent is to provide distance to keep the vortex vertical above the outlet tube 16*a*—not have it disturbed by the proximity of the horizontal flow path of the vapor 16 leaving outlet tube 16*a*. The position and size of the anti-creep ring 16*b* on the vapor outlet tube 16*a* are somewhat arbitrary. It is positioned close to, but below, the lip and is relatively small to allow room for coke to fall between the outer wall 20*a* and the ring 16*b*.

Details of the separator 20 below the outlet tube 16*a* have been dictated by concerns outside the bounds of this separator. As long as nothing is done to cause liquid to jet above the inlet 16*c* to the outlet tube 16*a*, there should be no impact to separation efficiency.

Chief areas of coking concern involve sections with vapor recirculation, or metal not well washed with liquid. The area 20*b* inside the top head may be shaped or filled with material to approximate the expected recirculation zone. The inside of the hub 25 is another potential trouble point. If coke were to grow and fall over the inlet 16*c* to vapor outlet tube 16*a*, a significant flow obstruction could occur (such as a closed check valve). For this reason, a cage or screen 25*c* of either rods or a pipe cap may be used. This would not prevent the coke from growing, but would hold most of it in place so that a large chunk is not likely to fall. Areas under the vane skirts and the skirts 16*b* on the vapor outlet tube 16*a* are also 'unwashed' and coke growth in these areas is possible.

The gaseous vaporized portion 16 of the crude oil and/or long residue feedstock 11 fed to the vapor/liquid separator 20 as a gas-liquid mixture from the first stage preheater 12 is subsequently fed through a vaporizer mixer 17, in which the vapor mixes with superheated steam 18 to heat the vapor to a higher temperature. The vapor is desirably mixed with superheated steam in order to ensure that the stream remains in a gaseous state by lowering the partial pressure of the hydrocarbons in the vapor. Since the vapor exiting the vapor/liquid separator is saturated, the addition of superheated steam will minimize the potential for coking fractions in the vapor to condense on inner surfaces of the unheated external piping connecting the vapor/liquid separator to the second stage preheater. The source of the superheated steam is a steam feed 18 into the convection section of the pyrolysis furnace between the first and second stage preheaters. The flue gases from the radiant section preferably act as the heating source for increasing the temperature of the steam to a superheated state.

Suitable superheated steam temperatures are not particulary limited at the high end, and should be sufficient to provide a measure of superheating above the dew point of the vapor. Generally, the superheated steam is introduced to the vaporizer mixer 17 at a temperature ranging from about 450° C. to 600° C.

The vaporizer mixer 17 is preferably located external to the pyrolysis furnace, again for ease of maintenance. Any conventional mix nozzle may be used, but it is preferred to use a mix nozzle as described in U.S. Pat. No. 4,498,629 to Grondman, entitled "Apparatus for vaporization of a heavy hydrocarbon feedstock with steam," which is fully incorporated herein by reference, in order to further minimize the coking potential around the inner surfaces of the mix nozzle. The preferred mix nozzle as described in U.S. Pat. No. 4,498,629 comprises a first tubular element and a second tubular element surrounding the first tubular element to form an annular space. The first tubular element and the second tubular element have substantially coinciding longitudinal axes. A first inlet means is provided for introducing the vaporized crude oil and/or long residue or long residue feedstock into the first tubular element and a second inlet means is provided for introducing superheated steam into the annular space. The first tubular element and the second tubular element are each provided with an open end for the supply of the superheated steam as an annulus around a core of the vapor feed, the open ends terminating in openings arranged in a plane, substantially perpendicular to the longitudinal axes. The apparatus also includes a frustoconically shaped element at one end connected to the open end of the second tubular element, provided with a longitudinal axis substantially coinciding with the longitudinal axes of the tubular elements and diverging in a direction away from the second tubular element, the frustoconically shaped element having an apex angle of at most 20 degrees. The arrangement of a slightly diverging frustoconically shaped element behind the location where the superheated steam meets the feed prevents the contact of liquid droplets with the wall of the element thereby minimizing the risk of coke formation in the mix nozzle.

The superheated steam/gas mixture exits the vaporizer mixer 17 through line 19, is fed to the second stage preheater 21 and is heated in the second stage preheater through tubes heated by the flue gases from the radiant section of the furnace. In the second stage preheater 21, the mixed superheated steam-gas mixture is fully preheated to near or just below a temperature at which substantial feedstock cracking and associated coke laydown in the preheater would occur. The mix feed subsequently flows to the radiant section B through line 22 of the olefins pyrolysis furnace where the gaseous hydrocarbons are thermally cracked to olefins and associated by products exiting the furnace through line 23. Typical inlet temperatures to the radiant zone B are above 480° C., more preferably at least 510° C., most preferably at least 537° C., and at least 732° C. at the exit, more preferably at least 760° C., and most preferably between 760° C. and 815° C., to promote cracking of long and short chain molecules to olefins. Products of an olefins pyrolysis furnace include, but are not limited to, ethylene, propylene, butadiene, benzene, hydrogen, and methane, and other associated olefinic, paraffinic, and aromatic products. Ethylene is the predominant product, typically ranging from 15 to 30 wt %, based on the weight of the vaporized feedstock.

Figure 5:
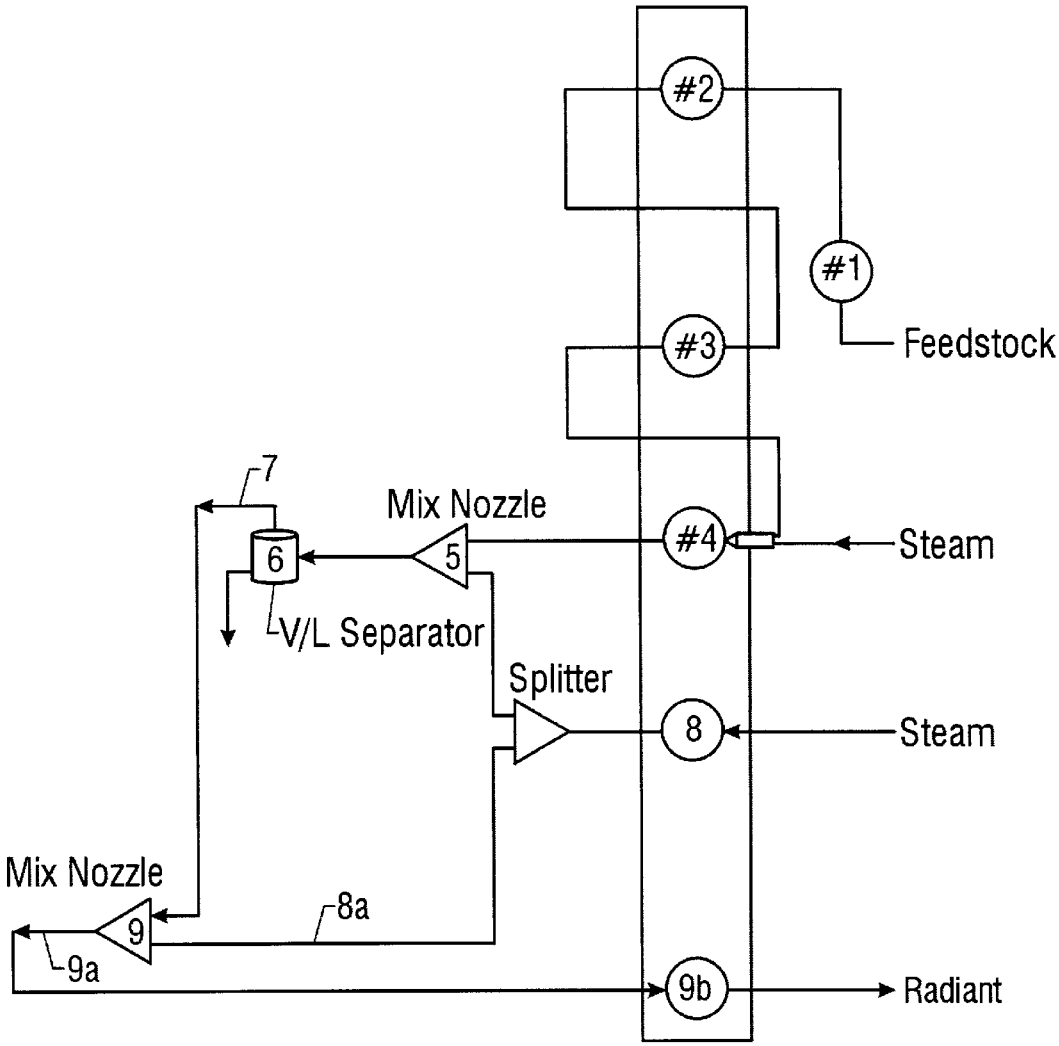
FIG. 5 is a schematic process flow diagram of a pyrolysis furnace.

In an optional embodiment, superheated steam may be added to the first stage preheater 12 in the convection section through line 13 in lieu of dilution steam as shown in FIG. 1, or may be added between the exit port of the first stage preheater and the vapor/liquid separator as shown in FIG. 5, for the purpose of further elevating the temperature of the gas-liquid mixture so desired, thereby increasing the fractions and weight percentage of vapor recovered from the crude oil and/or long residue feedstock.

The percentage of vaporized components in a gas-liquid mixture within the first preheater may be adjusted by controlling the flash temperature, the quantity of optional dilution steam added, and the quantity and temperature of optional superheated steam added to the crude oil and/or long residue feedstock in the first stage preheater 12. The amount of vapor recovered from the crude oil and/or long residue feedstock should not exceed the stated gas-liquid ratio, that is, no greater than 98/2, in order to minimize coking.

The process of the invention inhibits coke formation within the vapor/liquid separator 20, the vaporizer mixer 17, and in the second stage preheater 21, by continually wetting the heating surfaces within the first stage preheater and the vapor/liquid separator. The process of the invention achieves high recovery of crude oil and/or long residue fractions not otherwise obtainable at first stage preheater temperatures of 350° C. or less, while simultaneously inhibiting coke formation.

The pyrolysis furnace may be any type of conventional olefins pyrolysis furnace operated for production of lower molecular weight olefins, especially including a tubular steam cracking furnace. The tubes within the convection zone of the pyrolysis furnace may be arranged as a bank of tubes in parallel, or the tubes may be arranged for a single pass of the feedstock through the convection zone. At the inlet, the feedstock may be split among several single pass tubes, or may be fed to one single pass tube through which all the feedstock flows from the inlet to the outlet of the first stage preheater, and more preferably through the whole of the convection zone. Preferably, the first stage preheater is comprised of one single pass bank of tubes disposed in the convection zone of the pyrolysis furnace. In this preferred embodiment, the convection zone comprises a single pass tube having two or more banks through which the crude oil and/or long residue feedstock flows. Within each bank, the tubes may arranged in a coil or serpentine type arrangement within one row, and each bank may have several rows of tubes.

To further minimize coking in the tubes of the first stage preheater and in tubes further downstream and within the vapor/liquid separator, the linear velocity of the crude oil and/or long residue feedstock flow should be selected to reduce the residence time of coking fraction vaporized gases in the tubes. An appropriate linear velocity will also promote formation of a thin uniform wetted tube surface. While higher linear velocities of crude oil and/or long residue feedstock through the tubes of the first stage preheater reduce the rate of coking, there is an optimum range of linear velocity for a particular feedstock beyond which the beneficial rates of coke reduction begin to diminish in view of the extra energy requirements needed to pump the feedstock and the sizing requirements of the tubes to accommodate a higher than optimum velocity range. In general, crude oil and/or long residue linear velocity through the tubes of the first stage preheater in a convection section ranging from 1.1–2.2 m/s, more preferably from 1.7–2.1 m/s, and most preferably from 1.9–2.1 m/s, provide optimal results in terms of reducing the coking phenomenal balance against the cost of the tubes in furnace and the energy requirements.

One means for feeding a crude oil and/or long residue feedstock at a linear velocity within the range of 1.1–2.2 m/s is through any conventional pumping mechanism. In a preferred embodiment of the invention, the linear velocity of the crude oil and/or long residue feedstock is enhanced by injecting a small amount of liquid water into the crude feed prior to entry within the first stage preheater, or at any point desired within the first stage preheater. As the liquid water vaporizes in the crude oil and/or long residue feedstock, the velocity of the feed through the tubes increases. To achieve this effect, only small quantities of water are needed, such as 1 mole % water or less based on the moles of the feedstock through the first stage preheater tubes.

In many commercial olefins pyrolysis furnaces, the radiant section tubes accumulate sufficient coke every 3–5 weeks to justify a decoking operation on those tubes. The process of the invention provides for the preheating and cracking of a crude oil and/or long residue feedstock in a olefins furnace without having to shutdown the furnace for decoking operations any more often than the furnace would otherwise have to be shutdown in order to conduct the decoking treatment in the radiant section tubes. By the process of the invention, the convection section run period is at least as long as the radiant section run period.

In another embodiment of the invention, the convection section tubes are decoked on a regular scheduled basis at a frequency as required, and in no event more frequent than the frequency of radiant section decoking. Preferably, the convection section is decoked at a frequency at least 5 times longer, more preferably from at least 6 to 9 times longer than the radiant section decoking schedule. Decoking of a tube may be conducted with a flow of steam and air.

Figure 6:
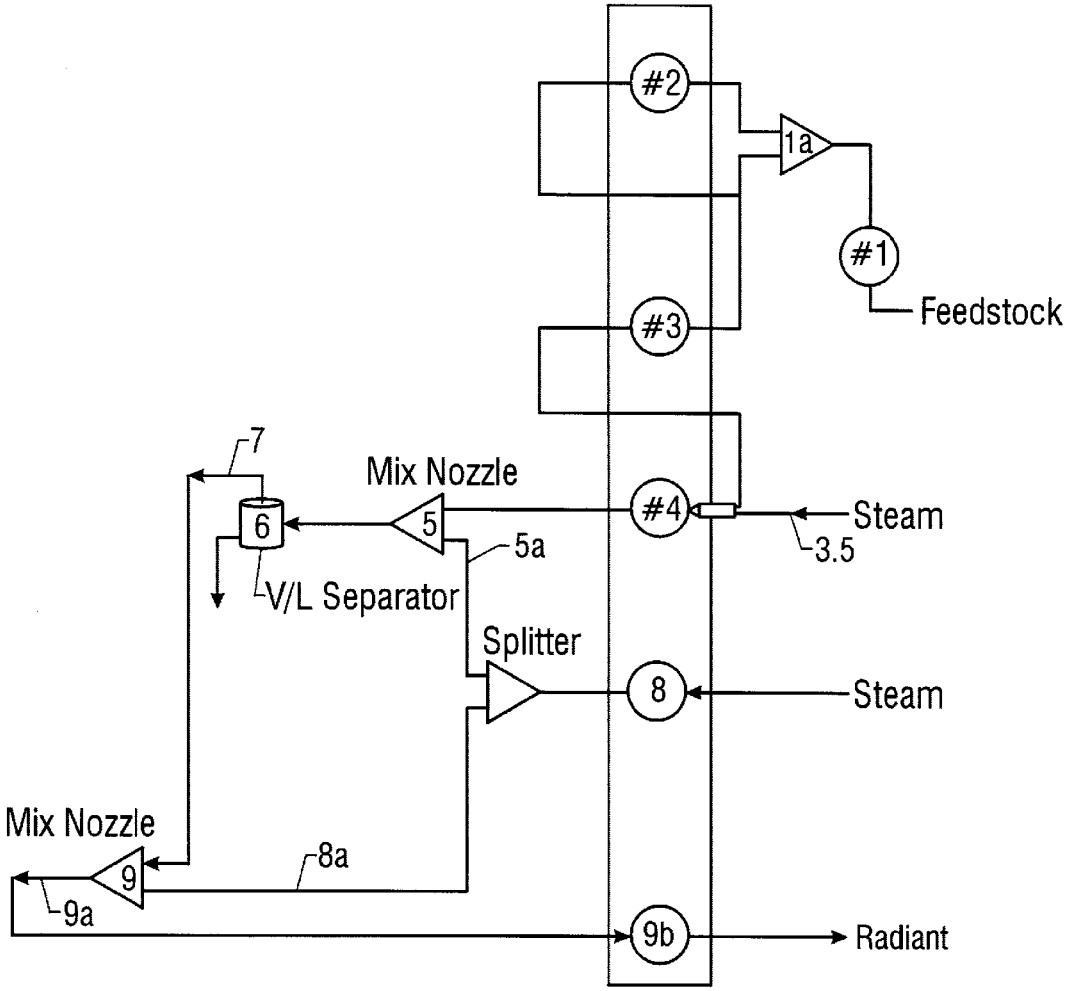
FIG. 6 is a schematic process flow diagram of a pyrolysis furnace.

In yet another embodiment of the invention, a flow of superheated steam is added to the first stage preheater tubes and/or between the exit point from the first stage preheater convection section and the vapor/liquid separator via a mix nozzle. Thus, there is provided an embodiment where a flow of superheated steam enters the convection zone, preferably between the first and second stage preheaters, thereby superheating the flow of steam to a temperature within a range of about 450° C.–600° C. As shown in FIG. 5 and FIG. 6, the source of superheated steam may be split by a splitter to feed a flow of superheated steam to the vapor-liquid separator 6 and a flow of superheated steam to a mix nozzle 5 located between the exit of the first stage preheater comprising the tube banks 2, 3, and 4 and the vapor/liquid separator 6.

Any conventional mix nozzle 5 may be used, but it is preferred to use a mix nozzle as described in U.S. Pat. No. 4,498,629 to Grondman, entitled "Apparatus for vaporization of a heavy hydrocarbon feedstock with steam," which is fully incorporated herein by reference, in order to further minimize the coking potential around the inner surfaces of the mix nozzle. The same type of nozzle described above with respect to the vaporizer 17 as shown in FIG. 1 is the preferred type of mix nozzle for mixing superheated steam with the gas/liquid mixture exiting the first stage preheater.

In yet a further embodiment of the invention, the feedstock may optionally be split by a splitter 1*a* as shown in FIG. 6, between heat exchangers 2 and 3, or between any other heat exchangers in the first preheater section of the convection section of the furnace. Such a splitter may be desirable when the feedstock contains a high weight percentage of pitch and is heated to a high temperature within the heat exchanger 1 in order to control its flowability, thereby obviating the need to process all of the feedstock through the first heat exchanger in the first preheater section of the convection zone.

The following prophetic example illustrates one of the embodiments of the invention and is not intended to limit the scope of the invention. This example is derived from the modeling program Simulated Sciences ProVision Version 5.1. Reference is made to FIG. 5 to illustrate this embodiment. In each case, the vapor/liquid mixture exiting the convection zone is at a temperature which exceeds 375° C. Under the pressure/temperature conditions described in the examples, lighter feeds such as heavy natural gas liquid would vaporize cracking fractions, causing the convection section to coke up at a much faster rate than the coking rate in a furnace processing the feedstocks under the conditions described below.

PROPHETIC EXAMPLE 1

A crude oil feed, having the properties listed below, is used as the feedstock:

API Gr. 37.08

ASTM D-2887 TBP

| Wt % | Deg C. |
|---|---|
| 1% | 24 |
| 10% | 111 |
| 20% | 170 |
| 30% | 225 |
| 40% | 269 |
| 50% | 309 |
| 60% | 368 |
| 70% | 420 |
| 80% | 477 |
| 90% | 574 |
| 97% | 696 |

This crude oil feedstock which has an API gravity 37.08, and an average molecular weight of 211.5, is fed at a temperature of 27° C. and a rate of 85,000 lbs/hr to an external heat exchanger(s) 1 to warm the crude oil to a temperature of 83° C. at a pressure of 201 psig prior to entry into the first bank of convection section heater tubes 2. The heated crude oil feedstock, still being all liquid at this point, is routed through the single pass first bank of tubes 2 having eight rows of tubes, each row spatially arranged in a serpentine fashion, and there is heated to a temperature of 324° C. and exits at a pressure of 148 psig. At this stage the liquid weight fraction is 0.845, and the liquid is flowing at a rate of 71,857 lbs/hr. The density of the liquid is 38.3 lbs/ft$^3$ and its average molecular weight is 247.4. The vapor phase flows at a rate of 13,143 lbs/hr and has an average molecular weight of 117.9 and a density of 1.94 lbs/ft$^3$.

The vapor/liquid mixture exits the first bank of tubes 2 and is fed to a second bank of tubes 3 identical to the first bank, where the vapor/liquid mixture is further heated to a temperature of 370° C. and exits at a pressure of 117 psig. The liquid weight fraction exiting this second bank of tubes is 0.608. The liquid now has a density of 38.7 lbs/ft$^3$ and has an average molecular weight of 312.7, and flows at a rate of 51,653 lbs/hr. The vapor phase flows at a rate of 33,347 lbs/hr and has an average molecular weight 141.0 and a density of 1.71 lb/cubic foot.

The vapor/liquid mixture is subsequently fed to a third bank of tubes 4 identical to the first and second bank of tubes, wherein the vapor/liquid mixture is further heated to a temperature of 388° C., and exits the third bank and the convection zone at that temperature and at a pressure of about 82 psig. At the third bank of tubes 4, a flow of 3000 lb/hr of dilution steam, stream 3.5, is fed to the third bank of tubes 4 at 137 psig and at 182° C. The liquid weight fraction exiting the third bank of tubes 4 is now reduced down to 0.362. The average molecular weight of the liquid phase at the exit of the third bank of tubes is increased to 419.4 and it has a density of 41.7 lbs/ft$^3$ flowing at a rate of 31,852 lbs/hr. The vapor phase flows at a rate of 56,148 lbs/hr, has an average molecular weight of about 114.0 and a density of 0.906 lbs/ft$^3$.

The vapor/liquid mixture exits the third bank of tubes 4 in the convection section of the ethylene furnace and flows to the Mix Nozzle 5. A flow 5*a* of about 38,903 lbs/hr of steam superheated to 594° C. at a pressure of 123.2 psig is injected into the vapor/liquid mixture exiting the convection zone through the Mix Nozzle 5. The resulting vapor/liquid mixture flows to a vapor/liquid separator 6 at a rate of 126,903 lbs/hr, at a temperature of 427° C., and at 80 psig. The average molecular weight of the liquid phase now has further increased to 696.0. The liquid weight fraction is now 0.070 due to the addition of superheated steam.

The vapor/liquid mixture is separated in the vapor/liquid separator 6. The separated liquids exit through the bottom of the separator. The separated vapor 7 exits the vapor/liquid separator at the top or through a side draw a rate of 118,017 lbs/hr and at a temperature of about 427° C. and a pressure of 80 psig. The average molecular weight of the vapor stream is about 43.5, and it has a density of 0.307 lbs/ft$^3$. The liquid bottom stream exiting the vapor/liquid separator is regarded as pitch and may be treated accordingly. The rate of pitch flow is about 8,886 lbs/hr, and exits at a temperature of about 427° C. at 80 psig. This liquid has a density of 47.0 lbs/ft$^3$ and an average molecular weight of 696.

The vapor stream 7 is combined with steam 8*a* heated in a bank of tubes 8. The steam through line 8*a* flows at a rate of about 3000 lbs/hr and is superheated to a temperature of 593° C. at a pressure of 123 psig. It flows through a Mix Nozzle 9 where it is combined with vapor stream 7 to produce a vapor stream 9*a* flowing at a rate of 121,017 lbs/hr at a temperature of 430° C. and a pressure of about 78 psig to the convection zone second stage preheater 9*b*, where it is further heated and passed to a radiant zone, not shown. The average molecular weight of the vapor stream 9*a* is 42.0 and its density is 0.289 lbs/ft$^3$.

The vapor stream subsequently flows back to the convection zone and into the radiant zone of the ethylene furnace to crack the vapor.

PROPHETIC EXAMPLE 2

A long residue stream derived from crude oil which originates as the bottoms stream of an atmospheric crude distillation column and has the properties listed below, is used as the feedstock:

API Gr. 25.85

ASTM D-2887 TBP

| Wt % | Deg C. |
|---|---|
| 0% | 220 |
| 10% | 356 |
| 20% | 391 |
| 30% | 414 |
| 40% | 432 |
| 50% | 447 |
| 60% | 467 |
| 70% | 492 |
| 80% | 536 |
| 90% | 612 |
| 98% | 770 |

This long residue feedstock which has an API gravity of 25.85 and an average molecular weight of 422.2 and is fed at a temperature of 38° C. and a rate of 95,000 lbs/hr to an external heat exchanger(s) 1 to warm the long residue to a temperature of 169° C. at a pressure of 249 psig prior to entry into the first bank of convection section heater tubes 2. The long residue feedstock, still being all liquid at this point, is routed through the single pass first bank of tubes 2 having eight rows of tubes, each row spatially arranged in a serpentine fashion, and there is heated to a temperature of 347° C. and exits as a liquid at a pressure of 175 psig.

The long residue has a denisty of 44.3 lbs/ft$^3$ as it exits the first bank of tubes 2 and is fed to a second bank of tubes 3 identical to the first bank, where it is further heated to a temperature of 394° C. and exits at a pressure of 132 psig. No vaporization takes place and entire stream exits as a liquid flowing at a rate of 95,000 lbs/hr with density is 41.9 lbs/ft$^3$.

The long residue is subsequently fed to a third bank of tubes 4 identical to the first and second bank of tubes, wherein it is further heated to a temperature of 410° C., and exits the third bank and the convection zone at that temperature and at a pressure of about 82 psig. At the third bank of tubes 4, a flow of 3000 lb/hr of dilution steam, stream 3.5, is fed to the third bank of tubes 4 at 137 psig and at 182° C. It leaves the third bank of tubes 4 as a vapor/liquid mixture having a liquid weight fraction of 0.830. The average molecular weight of the liquid phase at the exit of the third bank of tubes is 440.5 and it has a density of 41.6 lbs/ft$^3$ flowing at a rate of 81,348 lbs/hr. The-vapor phase flows at a rate of 16,652 lbs/hr, has an average molecular weight of about 80.5 and a density of 0.602 lbs/ft$^3$.

The vapor/liquid mixture exits the third bank of tubes 4 in the convection section of the ethylene furnace and flows to the Mix Nozzle 5. A flow 5*a* of about 39,593 lbs/hr of steam superheated to 589° C. at a pressure of 123 psig is injected into the vapor/liquid mixture exiting the convection zone through the Mix Nozzle 5. The resulting vapor/liquid mixture flows to a vapor/liquid separator 6 at a rate of 137,593 lbs/hr, at a temperature of 427° C., and at 80 psig. The average molecular weight of the liquid phase now has further increased to 599.0. The liquid weight fraction is now 0.208 due to the addition of superheated steam.

The vapor/liquid mixture is separated in the vapor/liquid separator 6. The separated liquids exit through the bottom of the separator. The separated vapor 7 exits the vapor/liquid separator at the top or through a side draw a rate of 108,988 lbs/hr and at a temperature of about 427° C. and a pressure of 80 psig. The average molecular weight of the vapor stream is about 42.9, and it has a density of 0.303 lbs/ft$^3$. The liquid bottom stream exiting the vapor/liquid separator is regarded as pitch and may be treated accordingly. The rate of pitch flow is about 28,605 lbs/hr, and exits at a temperature of about 427° C. at 80 psig. This liquid has a density of 45.1 lbs/ft$^3$ and an average molecular weight of 599.

The vapor stream 7 is combined with steam 8*a* heated in a bank of tubes 8. The steam through line 8*a* flows at a rate of about 3000 lbs/hr and is superheated to a temperature of 589° C. at a pressure of 123 psig. It flows through a Mix Nozzle 9 where it is combined with vapor stream 7 to produce a vapor stream 9*a* flowing at a rate of 111,988 lbs/hr at a temperature of about 430° C. and a pressure of about 78 psig to the convection zone second stage preheater 9*b*, where it is further heated and passed to a radiant zone, not shown. The average molecular weight of the vapor stream 9*a* is 41.3 and its density is 0.284 lbs/ft$^3$.

The vapor stream subsequently flows back to the convection zone and into the radiant zone of the ethylene furnace to crack the vapor.

What we claim is:

1. A process for pyrolyzing a feedstock comprising crude oil and/or crude oil fractions containing pitch in an olefins pyrolysis furnace comprising feeding said feedstock to a first stage preheater provided in a convection zone of said olefins pyrolysis furnace, heating said feedstock within said first stage preheater to a first temperature of at least 375° C. to produce a preheated gas-liquid mixture, withdrawing said preheated gas-liquid mixture from said first stage preheater to a vapor-liquid separator, separating and removing a gas fraction from a liquid fraction in said vapor-liquid separator, and feeding said gas fraction to a second stage preheater provided in said convection zone, further heating said gas fraction to a second temperature above said first temperature producing a preheated gas fraction, introducing said preheated gas fraction into a radiant zone of the pyrolysis furnace, and pyrolyzing the gas to a product comprising olefins.

2. The process of claim 1, wherein 85 wt. % or less of said crude oil and/or crude oil fractions containing pitch feedstock will vaporize at 350° C., and 90 wt. % or less of said crude oil and/or crude oil fractions containing pitch feedstock will vaporize at 400° C., each as measured according to ASTM D-2887.

3. The process of claim 1, wherein the feedstock has the following characteristics:

65 wt. % or less vaporizes at 300° C.;

80 wt. % or less vaporizes at 350° C.;

and 88 wt. % or less vaporizes at 400° C.; each as measured according to ASTM D-2887.

4. The process of claim 1, wherein the feedstock has the following characteristics:

60 wt. % or less vaporizes at 300° C.;

70 wt. % or less vaporizes at 350° C.; and 80 wt. % or less vaporizes at 400° C.; each as measured according to ASTM D-2887.

5. The process of claim 1, wherein the feedstock has the following characteristics:

55 wt. % or less vaporizes at 300° C.;

65 wt. % or less vaporizes at 350° C.; and 75 wt. % or less vaporizes at 400° C.; each as measured according to ASTM D-2887.

6. The process of claim 1, wherein the feedstock has the following characterics:

15 wt. % or less vaporizes at 350° C.; and 35 wt. % or less vaporizes at 400° C.

7. The process of claim 1, wherein the feedstock has the following characteristics:

10 wt. % or less vaporizes at 350° C.; and 30 wt. % or less vaporizes at 400° C.

8. The process of claim 1, wherein the feedstock is fed to the first stage preheater at a pressure ranging from 150 to 250 psig and at a temperature ranging from 140° C.–300° C.

9. The process of claim 1, wherein the feedstock in the first stage preheater is heated to an exit temperature of at least 400° C.

10. The process of claim 9, wherein the feedstock in the first stage preheater is heated to a temperature ranging from 400 to 520° C.

11. The process of claim 9, wherein the gas-liquid weight ratio ranges from 60/40 to 98/2.

12. The process of claim 9, wherein the first stage preheater comprises tubes, and the pressure within said tubes ranges from 50 psig to 300 psig.

13. The process of claim 9, wherein the first stage preheater comprises tubes, and the pressure within said tubes ranges from 60 psig to 180 psig.

14. The process of claim 1, wherein dilution gas is added to the feedstock in the first stage preheater.

15. The process of claim 14, wherein the dilution gas comprises dilution steam, and the temperature of the dilution steam added is below the temperature of the feedstock measured at the dilution steam juncture with the crude oil feedstock in the preheater tubes.

16. The process of claim 14, wherein the dilution gas comprises vaporized naphtha, refinery off gases, or a mixture thereof.

17. The process of claim 14, wherein the first stage preheater comprises tubes, and the amount of dilution gas added to the feedstock in said tubes is up to 0.5 lbs. of gas per lb. of feedstock.

18. The process of claim 17, wherein the dilution gas comprises dilution steam, and is added to the feedstock in the tubes of the first stage preheater in an amount of up to 0.3 lbs. of steam per lb. of feedstock.

19. The process of claim 1, wherein superheated steam is combined with the removed gas prior to entry into the second stage preheater.

20. The process of claim 19, wherein the temperature of the superheated steam ranges from 450° C. to 600° C.

21. The process of claim 1, wherein the first stage preheater comprises tubes, and the feedstock has a linear velocity through said tubes in the convection section ranging from 1.1–2.2 m/s.

22. The process of claim 21, wherein the feedstock linear velocity through the tubes of the first stage preheater in a convection section ranges from 1.9–2.1 m/s.

23. The process of claim 1, wherein said olefins comprise ethylene in an amount ranging from 15 to 30 wt. %, based on the weight of the vaporized feedstock.

24. The process of claim 1, wherein said feedstock is crude oil.

25. The process of claim 1, wherein said feedstock is long residue.

26. The process of claim 1, wherein water is added to the feedstock prior to entry into or within the first stage preheater tubes to increase the linear velocity of the feedstock.

27. The process of claim 26, wherein the amount of water added to the feedstock is 1 moles or less, based on the moles of the feedstock.

28. The process of claim 1, wherein the convection zone is decoked on a schedule no more frequent than the frequency for decoking the radiant zone of the pyrolysis furnace.

29. A process for pyrolyzing a crude oil or crude oil fraction containing pitch feedstock comprising feeding said feedstock to a first stage preheater within a convection zone of an olefins pyrolysis furnace, heating said feedstock to a temperature at which non-coking fractions and a portion of coking fractions are fully evaporated to a gas, while the remaining portion of coking fractions are maintained in a liquid phase, wherein the gas/liquid weight ratio of said feedstock in the first stage preheater is within a range of 60/40–98/2, withdrawing the gas/liquid mixture from the first stage preheater and feeding the gas/liquid mixture to a vapor-liquid separator, separating the gas from said gas/liquid mixture in the vapor-liquid separator and removing said gas from the vapor-liquid separator, feeding said removed gas to a second stage preheater in the convection zone, heating said gas in the second stage preheater, and feeding the second stage preheated gas to a radiant zone in the pyrolysis furnace.

30. The process of claim 29, wherein 85 wt. % or less of said crude oil and/or crude oil fractions containing pitch feedstock will vaporize at 350° C., and 90 wt. % or less of said crude oil and/or crude oil fractions containing pitch feedstock will vaporize at 400° C., each as measured according to ASTM D-2887.

31. The process of claim 29, wherein the feedstock has the following characteristics:

65 wt. % or less vaporizes at 300° C.;

80 wt. % or less vaporizes at 350° C.;

and 88 wt. % or less vaporizes at 400° C.; each as measured according to ASTM D-2887.

32. The process of claim 29, wherein the feedstock has the following characteristics:

60 wt. % or less vaporizes at 300° C.;

70 wt. % or less vaporizes at 350° C.; and 80 wt. % or less vaporizes at 400° C.; each as measured according to ASTM D-2887.

33. The process of claim 29, wherein the feedstock has the following characteristics:

55 wt. % or less vaporizes at 300° C.;

65 wt. % or less vaporizes at 350° C.; and 75 wt. % or less vaporizes at 400° C.; each as measured according to ASTM D-2887.

34. The process of claim 29, wherein the feedstock has the following characterics:

15 wt. % or less vaporizes at 350° C.; and 35 wt. % or less vaporizes at 400° C. each as measured according to ASTM D-2887.

35. The process of claim 29, wherein the feedstock has the following characteristics:

10 wt. % or less vaporizes at 350° C.; and 30 wt. % or less vaporizes at 400° C. each as measured according to ASTM D-2887.

36. The process of claim 29, wherein the feedstock in the first stage preheater is heated to a temperature ranging from greater than 400 to 520° C.

37. The process of claim 29, wherein a dilution gas is added to the feedstock in the first stage preheater.

38. The process of claim 37, wherein the dilution gas comprises dilution steam, vaporized naphtha, refinery off gases, nitrogen, methane, ethane, or mixtures thereof.

39. The process of claim 38, wherein the dilution gas comprises dilution steam, the first stage preheater comprises tubes, and the amount of dilution steam added to the feedstock in said tubes is up to 0.5 lbs. of steam per lb. of feedstock.

40. The process of claim 29, wherein superheated steam is combined with the removed gas prior to entry into the second stage preheater.

41. The process of claim 40, wherein the temperature of the superheated steam ranges from 450° C. to 600° C. preheater in the convection section ranging from 1.1–2.2 m/s.

42. The process of claim 29, wherein the first stage preheater comprises tubes, and the feedstock has a linear velocity through said tubes in the convection section ranging from 1.1–2.2 m/s.

43. The process of claim 42, wherein the feedstock linear velocity through the tubes of the first stage preheater in a convection section ranges from 1.9–2.1 m/s.

44. The process of claim 29, wherein said olefins comprise ethylene in an amount ranging from 15 to 30 wt. %, based on the weight of the vaporized feedstock.

45. The process of claim 29, wherein said feedstock is crude oil.

46. The process of claim 29, wherein said feedstock is long residue.

47. The process of claim 29, wherein the first stage preheater comprises tubes, and water is added to the feedstock prior to entry into or within said tubes to increase the linear velocity of the feedstock.

48. The process of claim 47, wherein the amount of water added to the feedstock is less than 1 mole %, based on the moles of the feedstock.

49. The process of claim 29, wherein the convection zone is decoked on a schedule no more frequent than the frequency for decoking the radiant zone of the pyrolysis furnace.

50. A process for pyrolyzing a crude oil or crude oil fraction containing pitch feedstock comprising feeding the feedstock to a first stage preheater in a convection zone of an olefins pyrolysis furnace further comprising a radiant zone, heating the feedstock in the first stage preheater to a temperature of at least 400° C., and feeding a dilution gas to said feedstock in the first stage preheater while heating said feedstock within the first stage preheater, wherein the gas-liquid weight ratio at an exit of said first stage preheater ranges from 60/40–98/2.

51. The process of claim 50, wherein 85 wt. % or less of said crude oil and/or crude oil fractions containing pitch feedstock will vaporize at 350° C., and 90 wt. % or less of said crude oil and/or crude oil fractions containing pitch feedstock will vaporize at 400° C., each as measured according to ASTM D-2887.

52. The process of claim 50, wherein the feedstock has the following characteristics:

65 wt. % or less vaporizes at 300° C.;

80 wt. % or less vaporizes at 350° C.;

and 88 wt. % or less vaporizes at 400° C.; each as measured according to ASTM D-2887.

53. The process of claim 50, wherein the feedstock has the following characteristics:

55 wt. % or less vaporizes at 300° C.;

65 wt. % or less vaporizes at 350° C.; and 75 wt. % or less vaporizes at 400° C.; each as measured according to ASTM D-2887.

54. The process of claim 50, wherein the feedstock has the following characterics:

15 wt. % or less vaporizes at 350° C.; and 35 wt. % or less vaporizes at 400° C. each as measured according to ASTM D-2887.

55. The process of claim 50, wherein the feedstock has the following characteristics:

10 wt. % or less vaporizes at 350° C.; and 30 wt. % or less vaporizes at 400° C. each as measured according to ASTM D-2887.

56. The process of claim 50, wherein the feedstock in the first stage preheater is heated to a temperature of 415° C. or more.

57. The process of claim 50, wherein the dilution gas comprises dilution steam, the first stage preheater comprises tubes, and the temperature of the dilution steam added is below the temperature of the feedstock measured at the dilution steam juncture with the crude oil feedstock in said tubes.

58. The process of claim 50, wherein the dilution gas comprises vaporized naphtha or dilution steam, wherein the amount of said dilution gas added to the feedstock in the tubes of the first stage preheater is up to 0.5 lbs. of steam per lb. of feedstock.

59. The process of claim 50, wherein said convection zone of an olefins pyrolysis furnace further comprises a second stage preheater, wherein superheated steam is combined with the removed gas prior to entry into said second stage preheater.

60. The process of claim 50, wherein the temperature of the superheated steam ranges from 450° C. to 600° C.

61. The process of claim 50, wherein the first stage preheater comprises tubes and the feedstock has a linear velocity through said tubes in the convection section ranging from 1.1–2.2 m/s.

62. The process of claim 61, wherein the feedstock linear velocity through the tubes of the first stage preheater in a convection section ranges from 1.9–2.1 m/s.

63. The process of claim 50, wherein said olefins comprise ethylene in an amoung ranging from 20 to 30 wt. %.

64. The process of claim 50, wherein said feedstock is crude oil.

65. The process of claim 50, wherein said feedstock is long residue.

66. The process of claim 50, wherein water is added to the feedstock prior to entry into or within the first stage preheater tubes to increase the linear velocity of the feedstock.

67. The process of claim 66, wherein the amount of water added to the feedstock ranges is less than 1 mole %, based on the moles of the feedstock.

68. The process of claim 50, wherein the convection zone is decoked on a schedule no more frequent than the frequency for decoking the radiant zone of the pyrolysis furnace.

* * * * *